US011058274B2

(12) United States Patent
Mueller et al.

(10) Patent No.: US 11,058,274 B2
(45) Date of Patent: Jul. 13, 2021

(54) SURFACE CLEANING MACHINE

(71) Applicant: Alfred Kärcher SE & Co. KG, Winnenden (DE)

(72) Inventors: Andreas Mueller, Oppenweiler (DE); Thomas Boerkircher, Affalterbach (DE); Rainer Kurmann, Aspach (DE); Thomas Zerrer, Berglen (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 103 days.

(21) Appl. No.: 16/125,109

(22) Filed: Sep. 7, 2018

(65) Prior Publication Data

US 2019/0000292 A1 Jan. 3, 2019

Related U.S. Application Data

(63) Continuation of application No. PCT/EP2016/055046, filed on Mar. 9, 2016.

(51) Int. Cl.

| | |
|---|---|
| ***A47L 11/40*** | (2006.01) |
| ***A47L 11/292*** | (2006.01) |
| ***A47L 11/282*** | (2006.01) |

(52) U.S. Cl.

CPC ..... *A47L 11/4041* (2013.01); *A47L 11/282* (2013.01); *A47L 11/292* (2013.01); *A47L 11/4016* (2013.01)

(58) Field of Classification Search

CPC .. A47L 11/4041; A47L 11/282; A47L 11/292; A47L 11/4016; A47L 11/4069; A47L 11/4038; A47L 11/4075; A47L 11/4058; A47L 11/22; A47L 11/24; A47L 11/28; A47L 11/29; A47L 11/40

See application file for complete search history.

(56) References Cited

U.S. PATENT DOCUMENTS

| | | | | |
|---|---|---|---|---|
| 1,436,420 A | | 11/1922 | Weydell | |
| 4,136,420 A | | 1/1979 | Cyphert et al. | |
| 4,173,054 A | * | 11/1979 | Ando | A47L 11/292 15/98 |
| 4,668,256 A | | 5/1987 | Billiet et al. | |

(Continued)

FOREIGN PATENT DOCUMENTS

| | | |
|---|---|---|
| CA | 2 411 936 | 11/2003 |
| CH | 607 578 | 9/1978 |

(Continued)

*Primary Examiner* — Robert J Scruggs

(74) *Attorney, Agent, or Firm* — Womble Bond Dickinson (US) LLP

(57) ABSTRACT

A surface cleaning machine is proposed which includes an appliance body and a cleaning head which is arranged on the appliance body, wherein at least one driven cleaning roller unit is positioned on the cleaning head and a dirty fluid tank device is arranged on the cleaning head, and a drive motor, wherein a scraper guide device which acts on the at least one cleaning roller unit is associated with the at least one cleaning roller unit, wherein the scraper guide device is arranged at an inlet orifice of the dirty fluid tank device, and wherein the scraper guide device is arranged and formed in such a way that dirty fluid is couplable from the at least one cleaning roller unit via the inlet orifice of the dirty fluid tank device into the dirty fluid tank device without a suction fan.

19 Claims, 8 Drawing Sheets

(56) References Cited

U.S. PATENT DOCUMENTS

| | | | | |
|---|---|---|---|---|
| 5,086,539 | A | 2/1992 | Rench | |
| 5,350,432 | A | 9/1994 | Lee | |
| 5,657,504 | A | 8/1997 | Khoury | |
| 6,026,529 | A * | 2/2000 | Caruso | A47L 11/03 15/97.1 |
| 6,400,048 | B1 | 6/2002 | Nishimura et al. | |
| 6,475,256 | B2 | 11/2002 | Matsubara et al. | |
| 6,662,402 | B2 | 12/2003 | Giddings et al. | |
| 6,735,812 | B2 | 5/2004 | Hekman et al. | |
| 7,128,770 | B2 | 10/2006 | Oh | |
| 7,143,461 | B2 * | 12/2006 | Spooner | A47L 11/33 15/41.1 |
| 7,150,068 | B1 | 12/2006 | Ragner | |
| 7,272,870 | B2 | 9/2007 | Pierce et al. | |
| 7,341,611 | B2 | 3/2008 | Greene et al. | |
| 7,559,963 | B2 | 7/2009 | Oh et al. | |
| 7,665,174 | B2 | 2/2010 | Basham et al. | |
| 7,921,497 | B2 | 4/2011 | Cook et al. | |
| 7,967,914 | B2 | 6/2011 | Giddings et al. | |
| 7,979,952 | B2 | 7/2011 | Beskow | |
| 8,016,996 | B2 | 9/2011 | Field et al. | |
| 8,025,786 | B2 | 9/2011 | Field et al. | |
| 8,230,549 | B2 | 7/2012 | Lenkiewicz et al. | |
| 9,289,105 | B2 | 3/2016 | Moes | |
| 9,999,332 | B2 | 6/2018 | Braendle et al. | |
| 2002/0194692 | A1 | 12/2002 | Giddings et al. | |
| 2003/0159232 | A1 | 8/2003 | Hekman et al. | |
| 2005/0160553 | A1 | 7/2005 | Gregory | |
| 2005/0262659 | A1 | 12/2005 | Roschi et al. | |
| 2007/0006404 | A1 | 1/2007 | Cheng et al. | |
| 2009/0089967 | A1 | 4/2009 | Yang et al. | |
| 2009/0119871 | A1 | 5/2009 | Dilger et al. | |
| 2009/0229075 | A1 * | 9/2009 | Eriksson | A47L 9/0477 15/383 |
| 2010/0132150 | A1 | 6/2010 | Egler et al. | |
| 2010/0236010 | A1 | 9/2010 | Johnson | |
| 2012/0066861 | A1 | 3/2012 | Louis et al. | |
| 2012/0222244 | A1 | 9/2012 | Conrad | |
| 2013/0091663 | A1 | 4/2013 | Mersmann | |
| 2013/0219641 | A1 | 8/2013 | Guijarro | |
| 2014/0000060 | A1 | 1/2014 | Demirtas et al. | |
| 2014/0150984 | A1 | 6/2014 | Nishikawa et al. | |
| 2014/0182079 | A1 | 7/2014 | Van Der Kooi et al. | |
| 2015/0082579 | A1 | 3/2015 | Lin | |
| 2016/0270613 | A1 | 9/2016 | Demirtas et al. | |
| 2016/0278597 | A1 | 9/2016 | Braendle et al. | |
| 2017/0215676 | A1 | 8/2017 | Moser et al. | |
| 2017/0215677 | A1 | 8/2017 | Moser et al. | |
| 2017/0215678 | A1 | 8/2017 | Moser et al. | |
| 2017/0215679 | A1 | 8/2017 | Moser et al. | |
| 2017/0215681 | A1 | 8/2017 | Moser et al. | |
| 2018/0228331 | A1 | 8/2018 | Moser et al. | |

FOREIGN PATENT DOCUMENTS

| | | | |
|---|---|---|---|
| CN | 2109165 | | 7/1992 |
| CN | 2174947 | | 8/1994 |
| CN | 2266377 | | 11/1997 |
| CN | 2675734 | | 2/2005 |
| CN | 1718149 | | 1/2006 |
| CN | 2845698 | Y | 12/2006 |
| CN | 201158807 | | 12/2008 |
| CN | 201384462 | | 1/2010 |
| CN | 201930938 | | 8/2011 |
| CN | 202151938 | | 2/2012 |
| CN | 102493381 | | 6/2012 |
| CN | 202313126 | | 7/2012 |
| CN | 203346836 | | 12/2013 |
| CN | 103690112 | | 4/2014 |
| CN | 204862995 | | 12/2015 |
| DE | 294 642 | | 10/1991 |
| DE | 41 17 957 | | 12/1992 |
| DE | 102 42 257 | | 4/2003 |
| DE | 10 2004 013 262 | | 9/2005 |
| DE | 10 2007 031 371 | | 1/2009 |
| DE | 10 2008 013 485 | | 11/2009 |
| EP | 0 012 337 | | 6/1980 |
| EP | 0 186 005 | | 7/1986 |
| EP | 0 844 843 | | 7/2002 |
| EP | 1 535 560 | | 1/2005 |
| EP | 1 465 518 | | 4/2005 |
| EP | 1 736 089 | | 12/2006 |
| EP | 1994868 | | 11/2008 |
| EP | 2 177 128 | | 4/2010 |
| EP | 2 387 932 | | 11/2011 |
| EP | 2 641 524 | | 9/2013 |
| EP | 2 721 988 | | 4/2014 |
| FR | 2 797 895 | | 3/2001 |
| GB | 1123052 | | 8/1968 |
| GB | 2 341 124 | | 3/2000 |
| GB | 2 411 823 | | 9/2005 |
| GB | 2 420 967 | | 6/2006 |
| GB | 2 435 820 | | 9/2007 |
| JP | 2000342495 | | 12/2000 |
| JP | 2001037695 | | 2/2001 |
| JP | 2005-211350 | | 8/2005 |
| JP | 2013081829 | | 5/2013 |
| WO | WO 84/04663 | | 12/1984 |
| WO | WO 90/14787 | | 12/1990 |
| WO | WO 97/06721 | | 2/1997 |
| WO | WO 00/78198 | | 12/2000 |
| WO | WO 01/037716 | | 5/2001 |
| WO | WO 02/28251 | | 4/2002 |
| WO | WO 02/069775 | | 9/2002 |
| WO | WO 2005/089614 | | 9/2005 |
| WO | WO 2005/096907 | | 10/2005 |
| WO | WO 2006/102147 | | 9/2006 |
| WO | WO 2006/110459 | | 10/2006 |
| WO | WO 2010/041185 | | 4/2010 |
| WO | WO 2010/140967 | | 12/2010 |
| WO | WO 2013/027140 | | 2/2013 |
| WO | WO 2013/027164 | | 2/2013 |
| WO | WO 2013/106762 | | 7/2013 |
| WO | WO2015086083 | * | 6/2015 |

* cited by examiner

SURFACE CLEANING MACHINE

CROSS-REFERENCE TO RELATED APPLICATIONS

This application is a continuation of International Patent Application Number PCT/EP2016/055046, filed Mar. 9, 2016, which is incorporated herein by reference in its entirety and for all purposes.

BACKGROUND OF THE INVENTION

The invention relates to a surface cleaning machine comprising an appliance body, a cleaning head which is arranged on the appliance body, wherein at least one driven cleaning roller unit is positioned on the cleaning head and a dirty fluid tank device is arranged on the cleaning head, and a drive motor.

A surface cleaning machine with rotating brushes is known from WO 2010/041185 A1.

A cleaning head for a floor cleaning machine is known from U.S. Pat. No. 7,665,174 B2.

A floor cleaner which comprises a handle, a main body, a roller mechanism comprising a roller with a cleaning belt, a scraper and a dirty fluid receptacle is known from U.S. Pat. No. 4,173,054.

A surface cleaning machine with a cleaning roller and a drive unit for driving the cleaning roller is known from WO 2013/106762 A2. A dirt tray is provided into which the cleaning roller sweeps the dirt when it is rotating. The dirt tray can be opened.

A floor scrubbing appliance which is operated manually and comprises a drive roller which is coupled to a scrubbing roller is known from U.S. Pat. No. 7,921,497 B2.

Surface cleaning machines are known from the not pre-published applications PCT/EP2015/073275, PCT/EP2015/072929, PCT/EP2015/073529, PCT/EP2015/073116, PCT/EP2015/073478. A surface cleaning machine is likewise known from the not pre-published PCT/EP2015/073315.

SUMMARY OF THE INVENTION

In accordance with an embodiment of the invention, a surface cleaning machine is provided, which is of simple construction and exhibits advantageous operating characteristics.

In accordance with an embodiment of the invention, a surface cleaning machine is provided, comprising a scraper guide device which acts on the at least one cleaning roller unit is associated with the at least one cleaning roller unit, wherein the scraper guide device is arranged at an inlet orifice of the dirty fluid tank device, and wherein the scraper guide device is arranged and formed in such a way that dirty fluid is couplable from the at least one cleaning roller unit via the inlet orifice of the dirty fluid tank device into the dirty fluid tank device without a suction fan.

Dirty fluid can be removed from the at least one cleaning roller unit by means of the scraper guide device, in particular, by virtue of a scraping effect. The dirty fluid that has been removed can then be guided by the scraper guide device into the dirty fluid tank device.

The dirty fluid tank device is then arranged in such a way that dirty fluid that has been removed from the at least one cleaning roller unit can reach the dirty fluid tank device by minimization of the corresponding transportation path.

The corresponding surface cleaning machine can be constructed without a suction fan. A simple construction of low weight can thereby be realized.

No lines have to be provided for subjecting the cleaning roller unit to negative pressure for the purposes of sucking away dirty fluid. Furthermore, the surface cleaning machine does not comprise an additional power consuming device (a suction fan). A separator does not have to be provided. It can thus be operated in an energy-saving manner and in particular thereby can be advantageously operated by a battery device and in particular a rechargeable battery device.

Furthermore, a self-cleaning effect for the at least one cleaning roller unit can, to a certain extent, be achieved by the scraper guide device.

When the surface cleaning machine is operative, the at least one driven cleaning roller unit (which, in particular, can additionally be moistened) acts on a surface that is to be cleaned. The driven cleaning roller unit carries out a wiping movement so that the amount of energy expended by a user for a cleaning process is reduced.

Furthermore, dirty fluid is picked up by the cleaning roller unit and transferred to the dirty fluid tank device. Consequently, the user does not come into contact with dirty fluid.

A cleaning roller unit is, in particular, a one-piece cleaning roller or a multipart cleaning roller having the same rotational axis for all the parts.

It is expedient if the scraper guide device is arranged and formed in such a way that dirty fluid which has been picked up by the at least one cleaning roller unit is scraped off the at least one cleaning roller unit by the scraper guide device and is guided into the dirty fluid tank device. Removal of dirty fluid then follows by means of a scraping (stripping) process. The guide device provides for the supply to the dirty fluid tank device. For example, the guide device can provide at least partially for bouncing off the dirty fluid and spinning it away into the dirty fluid tank device by the effect of centrifugal force for example.

Expediently, the scraper guide device is arranged after the inlet orifice taken with respect to a direction of rotation of the at least one cleaning roller unit. Consequently, the scraper guide device can remove dirt from the cleaning roller unit in particular by means of a scraping effect and guide the dirt into the inlet orifice. For example, the scraper guide device forms a wall of the inlet orifice.

Furthermore, it is expedient if the scraper guide device is arranged and formed in such a way that dirty fluid is removed from the at least one cleaning roller unit by means of a scraping process. A simple way of supplying dirty fluid to the dirty fluid tank device thereby results.

It is especially particularly advantageous, if the scraper guide device projects into a trimming of the at least one cleaning roller unit. Dirty fluid can thereby be scraped off the at least one cleaning roller unit by means of the scraper guide device.

In particular, the scraper guide device projects into the trimming of the at least one cleaning roller unit to a depth of at least 5% of a thickness of the trimming in respect of a moist trimming.

As a result of this inward projection, there results a scraping effect. If the scraper guide device does not project too deeply into the trimming of the at least one cleaning roller unit, then the rotation of the at least one cleaning roller unit is not made excessively difficult.

The scraper guide device is arranged on the dirty fluid tank device or on a cleaning roller holder for the at least one cleaning roller unit. It can thereby be positioned relative to the at least one cleaning roller unit in a defined manner.

In one exemplary embodiment, the scraper guide device is removable from the cleaning head with the dirty fluid tank device. A simple constructional assembly thereby results. Furthermore, the scraper guide device can be cleaned in a simple manner. For example, the scraper guide device then forms a wall of the inlet orifice.

It is expedient if the scraper guide device is rounded-off or chamfered at an edge thereof trimming the inlet orifice. The fibers of the trimming are better "preserved" by such a rounding and/or chamfering process when the scraper guide device is in action. A smaller amount of torque has to be used for the rotation of the cleaning roller unit so that an energy-saving operation thereby results.

In particular, the scraper guide device is formed by one or more edge elements. The edge elements are strips having corresponding edges which project, in particular, into the trimming of the at least one cleaning roller unit. The one or the plurality of edge elements can thereby form a wall of the inlet orifice. In particular, an edge of an edge element is rounded-off or chamfered whereby, taken with respect to a direction of rotation of the cleaning roller unit, this rounded-off or chamfered edge borders on the inlet orifice.

In one embodiment, there is associated with the at least one cleaning roller unit at least one sweeping element by means of which coarse dirt is suppliable to the at least one cleaning roller unit and is then conveyable thereby. The sweeping element ensures that "swept-up" coarse dirt is supplied to the at least one cleaning roller unit for conveyance thereby. The extent of the field of use of the surface cleaning machine is thereby increased.

In one exemplary embodiment, the inlet orifice of the dirty fluid tank device is positioned between the scraper guide device and the sweeping element associated with the at least one cleaning roller unit taken with respect to a direction of rotation of the at least one cleaning roller unit. Dirty fluid can thereby be picked up from the surface that is to be cleaned. Furthermore, coarse dirt can be supplied to the at least one cleaning roller unit. The latter conveys the dirt therewith up to the scraper guide device. There, the dirty fluid is removed and can then be supplied to the inlet orifice of the dirty fluid tank device.

The at least one sweeping element is, for example, arranged on the dirty fluid tank device or on a cleaning roller holder. A defined position in relation to the at least one cleaning roller unit can thereby be achieved.

In one exemplary embodiment, the cleaning head is arranged on the appliance body in pivotal manner. A more extensive range of use thereby results. If, for example, there are space restrictions, then the appliance body can be repositioned vis a vis the cleaning head as required due to the pivotability.

For example, the drive motor (for the at least one cleaning roller unit) is arranged on the appliance body outside a housing of the appliance body or it is arranged at least partly in the housing of the appliance body. A simple constructional assembly thereby results. For example, an enclosure of the drive motor can be used for the formation of a swivel joint.

In one exemplary embodiment, at least one first cleaning roller unit and one second cleaning roller unit are provided, wherein the first cleaning roller unit and the second cleaning roller unit are driven in opposite rotary directions. This results in a better cleaning effect as (at least) two cleaning roller units are then able to act on the surface area. Hereby, each cleaning roller unit is associated with the its own scraper guide device part.

Hereby, provision may be made for at least one common tank of the dirty fluid tank device to be associated with the first cleaning roller unit and the second cleaning roller unit. This thereby results in a simple constructional assembly. However, it is also possible for an individual tank to be associated with each cleaning roller unit.

In one embodiment, the inlet orifice of the dirty fluid tank device has a longitudinally extending direction which is oriented at least approximately parallel to a rotational axis of the at least one cleaning roller unit. This thereby results in a larger cleaning range due to the at least one cleaning roller unit having a correspondingly large removal region for dirty fluid.

In particular, the inlet orifice of the dirty fluid tank device has a length which at least corresponds to a length of the trimming on the at least one cleaning roller unit. Dirty fluid can thereby be removed effectively.

The surface cleaning machine in accordance with the invention is, in particular, in the form of a handheld or hand-guided surface cleaning machine. The user can preferably hold or guide the surface cleaning machine with one hand.

BRIEF DESCRIPTION OF THE DRAWINGS

The following description of preferred embodiments serves to provide a more detailed explanation of the invention taken in conjunction with the drawings. Therein.

DETAILED DESCRIPTION OF THE INVENTION

Figure 1:
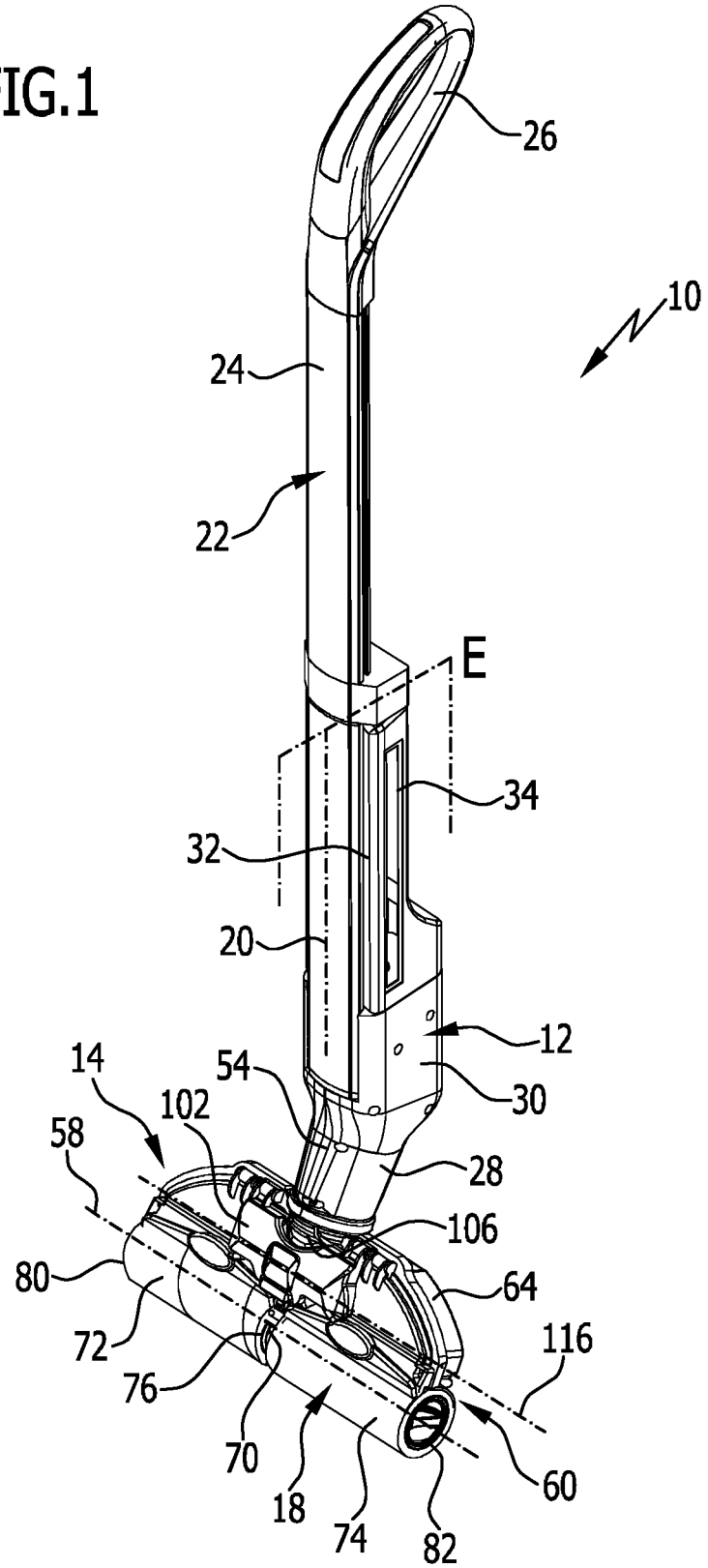
FIG. 1 shows a perspective illustration of an exemplary embodiment of a surface cleaning machine in accordance with the invention.

A first exemplary embodiment of a surface cleaning machine in accordance with the invention which is shown in FIG. 1 and is partially illustrated in FIGS. 2 to 10 and which is denoted generally by 10 is, in particular, in the form of a handheld and hand-guided floor cleaning machine for hard floors.

The surface cleaning machine 10 comprises an appliance body 12 and a cleaning head 14. The cleaning head 14 is arranged on the appliance body 12.

When performing a cleaning process on a surface 16 that is to be cleaned, the surface cleaning machine 10 is supported on the surface 16 that is to be cleaned by a cleaning roller unit 18 and in particular, by a single cleaning roller unit 18. The cleaning roller unit 18 has a single rotational axis (see below). The cleaning roller unit 18 is a cleaning roller which can be formed in one-piece or comprise multiple parts. In the embodiment described below, the cleaning roller unit 18 is a two-piece cleaning roller.

The appliance body 12 comprises a longitudinal axis 20. The surface cleaning machine 10 is held by a handle or guided by a handle. To this end, a holding bar device 22 is seated on the appliance body 12.

In one exemplary embodiment, the holding bar device 22 comprises a (in particular, exactly one) holding bar 24 which extends longitudinally in parallel with the longitudinal axis 20. A grip 26 and in particular a bow-type handle is arranged in an upper region of the holding bar device 22. A user can hold the surface cleaning machine 10 single-handedly by means of this grip 26 and guide it over the surface 16 that is to be cleaned (by the cleaning roller unit 18 which is supported thereon).

The holding bar device 22 can be formed such that its length is variable or fixed along a length of the longitudinal axis 20.

The dimensions of the surface cleaning machine 10 are such that a user can comfortably carry out a process of cleaning the surface 16 that is to be cleaned with a bent arm when the cleaning roller unit 18 is resting on the surface 16 that is to be cleaned. In particular, a length of the surface cleaning machine 10 along the longitudinal axis 20 between the cleaning roller unit 18 and the hooplike grip 26 lies in a range of between 60 cm and 130 cm.

In particular, one or more control elements are arranged on the grip 26. For example, a switch by means of which the surface cleaning machine 10 is capable of being switched-on or switched-off for a cleaning operation is arranged thereon. The operation of a drive motor 28 for rotational operation of the cleaning roller unit 18 is controllable by this switch. Furthermore, a switch can be provided for actuating a valve device 38 (see below).

The appliance body 12 comprises a housing 30 in which the components of the surface cleaning machine 10 are arranged and protected.

A holder 32 is arranged on the housing 30. A tank device 34 for a cleaning liquid (in particular, water with or without an additional detergent) is arranged on the holder 32 such as to be removable.

On the housing 30, a tank receptacle 36 for the tank device 34 is arranged on the holder 32. A corresponding outlet opening of the tank device 34 is connectable to the tank receptacle 36.

In the housing 30, the tank receptacle 36 is positioned after a valve device 38.

One or more fluid lines 40 lead to the cleaning head 14 from the valve device 38.

The valve device 38 comprises a non-return valve by means of which the supply of cleaning liquid from the tank device 34 to the cleaning head 14 is selectively blockable. A filter device 39 for the cleaning liquid may be associated with the valve device 38. In particular, the filter device 39 is arranged upstream of the non-return valve and between the valve device 38 and the tank receptacle 36.

When the non-return valve is open, cleaning liquid can flow out of the tank device 34 through the fluid line or fluid lines 40 to the cleaning head 14 and be applied to the surface 16 that is to be cleaned.

To this end, one or more outlet openings for the cleaning liquid are provided in the cleaning head 14. In principle thereby, it is possible for the outlet opening or outlet openings to be arranged such that the surface 16 that is to be cleaned is acted upon directly by the cleaning liquid.

In one advantageous variant, the outlet opening or outlet openings are arranged in such a way that the cleaning roller unit 18 and in particular a trimming 42 of the cleaning roller unit 18 is acted upon by the cleaning liquid. In the case where the cleaning liquid is applied to the cleaning roller unit 18, the surface 16 that is to be cleaned is then acted upon indirectly by the cleaning liquid.

In particular, the trimming 42 is made of a textile material.

Associated with the valve device 38, there is a switch by means of which the user can select whether the non-return valve of the valve device 38 is closed (i.e. the supply of cleaning liquid to the cleaning head 14 is blocked), or whether the non-return valve is open (i.e. the path for the supply of cleaning liquid from the tank device 34 to the cleaning head 14 is clear).

This switch can be arranged on the housing 30. In principle, it is also possible for the switch to be arranged on the grip 26.

In one exemplary embodiment, a battery device 44 for the supply of electrical power to the drive motor 28 is arranged in the housing 30. The battery device 44 is re-chargeable. Thus, the surface cleaning machine 10 can be operated independently of a mains supply.

In principle however, it is also possible for the surface cleaning machine 10 to be operated by mains current. An appropriate connecting device for mains current must then be arranged on the surface cleaning machine 10.

Hereby, the battery device 44 can be removable from the appliance body 12 in order to enable recharging to be effected by an appropriate battery charger.

Provision could also be made for an appropriate charging device to be integrated into the appliance body 12 and a recharging process without removing the battery device 44 from the appliance body 12 is then feasible. Appropriate terminal connectors are arranged on the holding bar 24 for example.

The drive motor 28 is an electric motor. It comprises a motor axis 46. The motor axis 46 is coaxial with a rotational axis of the drive motor 28.

The drive motor 28 is seated between the cleaning head 14 and the housing 30 on the appliance body 12.

In one exemplary embodiment, the motor axis 46 is oriented at an angle to the longitudinal axis 20 of the appliance body 12 (and the holding bar 24). The angle between the motor axis 46 and the longitudinal axis 20 lies for example in a range of between 150° and 170°.

Figure 2:
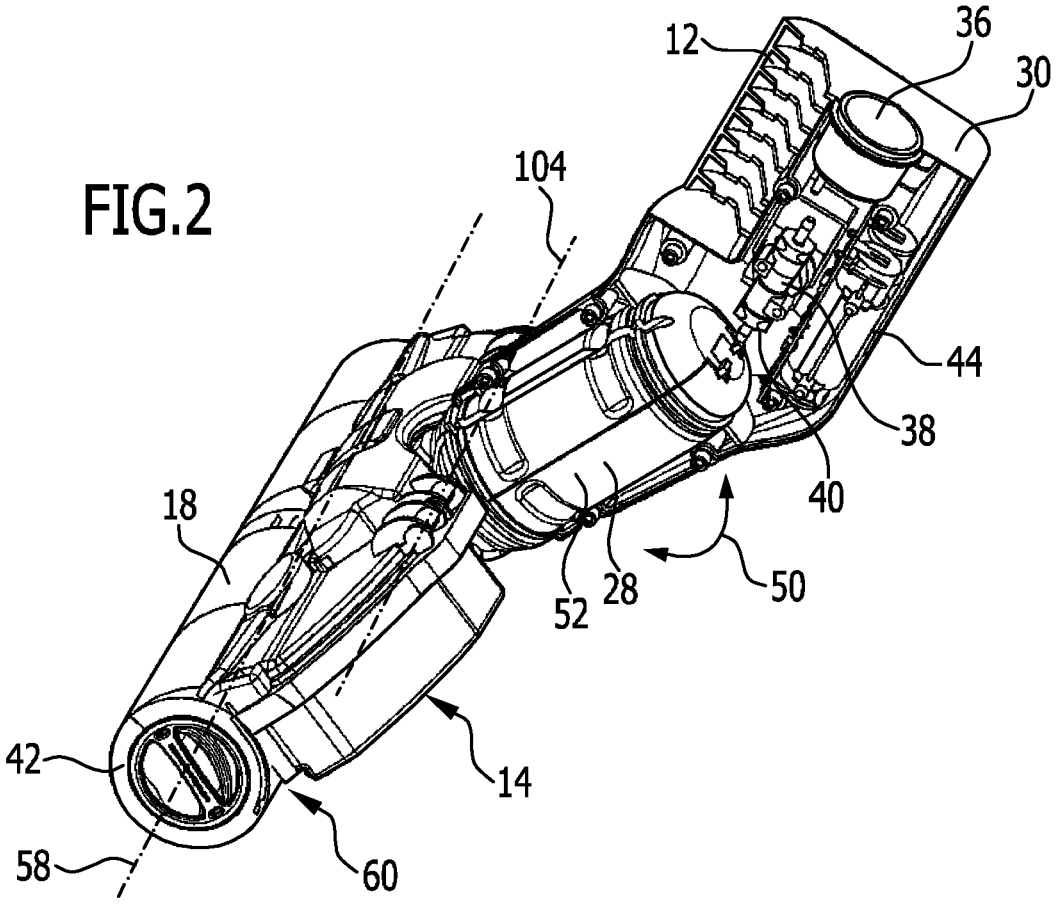
FIG. 2 a further perspective illustration of a cleaning head of the surface cleaning machine in accord with FIG. 1, wherein a connection to an appliance body is depicted.
Figure 3:
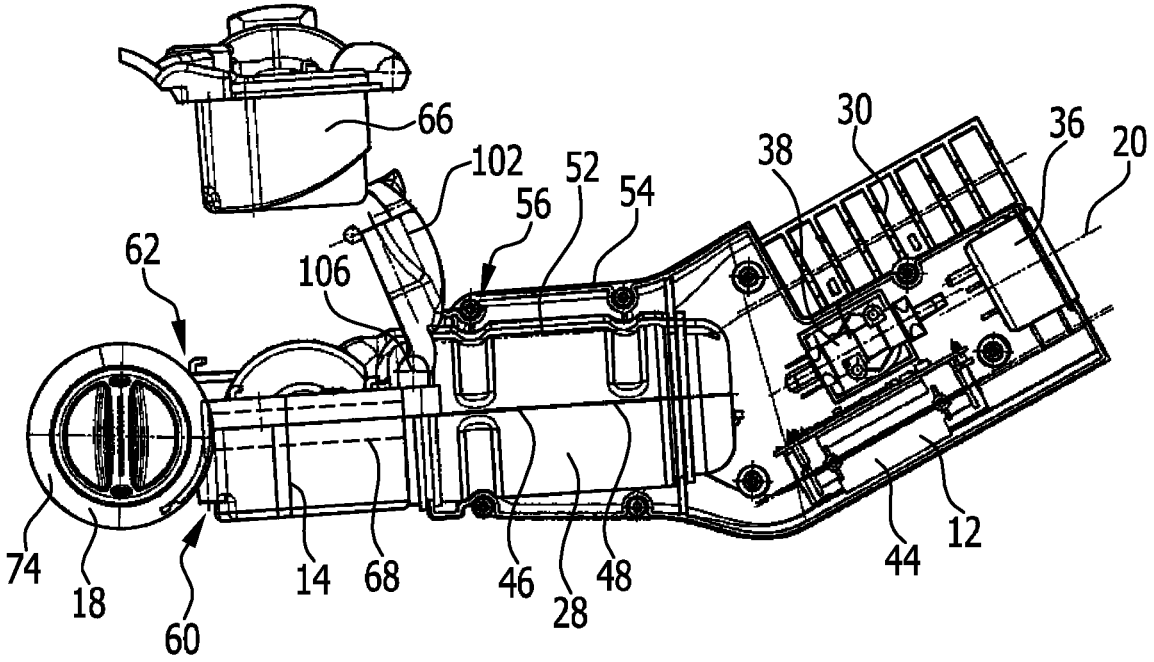
FIG. 3 a side view of the cleaning head in accordance with FIG. 2 wherein a dirty fluid tank device is removed.
Figure 4:
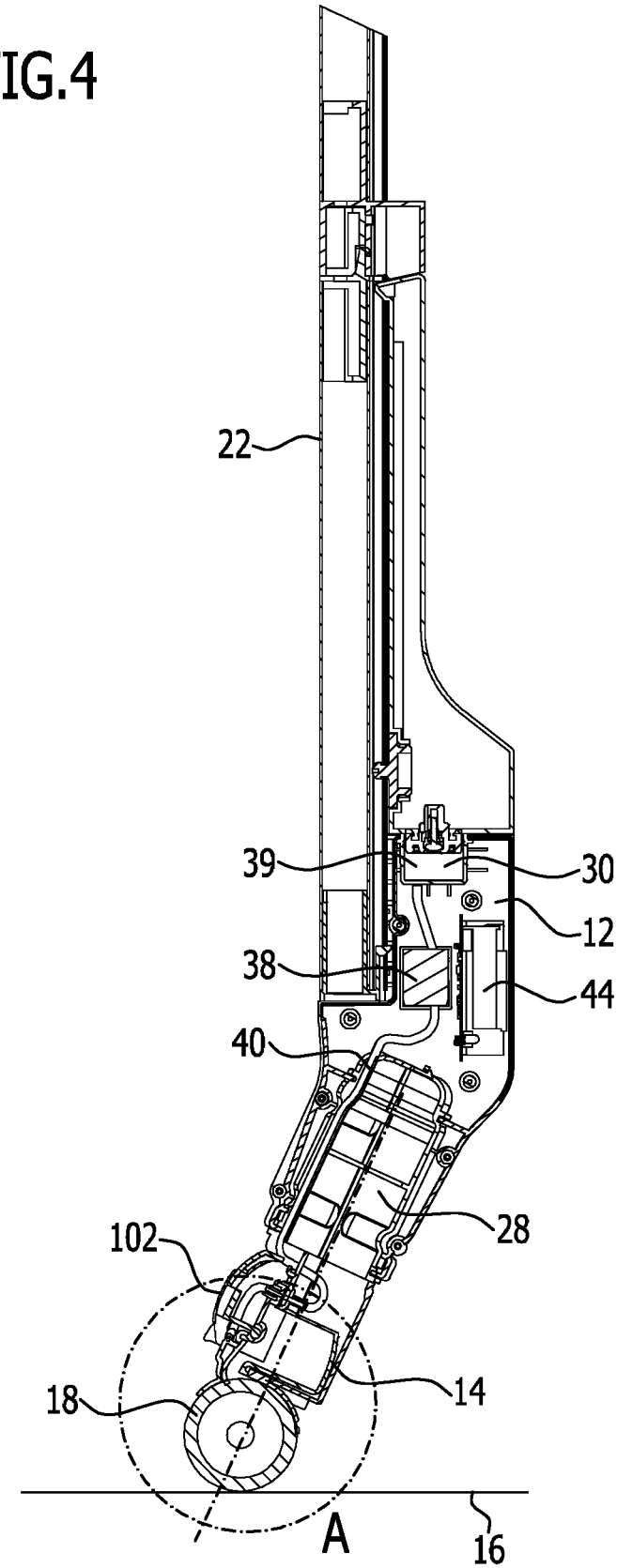
FIG. 4 a partial sectional view in the plane E in accordance with FIG. 1.

In one exemplary embodiment, the cleaning head 14 is pivotal with respect to the appliance body 12 about a pivotal axis 48 (c.f. FIGS. 2 and 3). This pivotal property is indicated in FIG. 2 by the double arrow bearing the reference symbol 50.

In particular, the pivotal axis 48 is coaxial with the motor axis 46.

In one embodiment, the drive motor 28 is arranged on an inner sleeve 52. This inner sleeve 52 preferably forms an enclosure for the drive motor 28.

An outer sleeve 54 is seated firmly on the appliance body 12. The inner sleeve 52 is seated in the outer sleeve 54. Hereby, the inner sleeve 52 is pivotal relative to the outer sleeve 54 about the pivotal axis 48, the inner sleeve 52 being mounted in pivotal manner in the outer sleeve 54. The inner sleeve 52 and the outer sleeve 54 form a swivel joint 56 which provides for the pivotal mounting of the cleaning head 14 relative to the appliance body 12. The drive motor 28 is thereby pivotal relative to the appliance body 12 about the pivotal axis 48. Appropriate leads from the battery device 44 to the drive motor 28 are arranged and formed in such a way that they permit the pivotal movement. In corresponding manner, the fluid line 40 or the fluid lines 40 are formed in such a way that they too permit this pivotal movement.

The swivel joint 56 has a basic position which, for example, is defined in that a (the only) rotational axis 58 of the cleaning roller unit 18 is oriented perpendicularly to the plane E in accordance with FIG. 1. A pivotal movement about the pivotal axis 58 with respect to this basic position manifests itself as an angular position of the rotational axis 58 relative to the plane E.

In particular, the swivel joint 56 is adjusted in such a manner that, compared with a normal cleaning operation, it is necessary to exert a certain amount of force in order to cause a pivotal movement of the cleaning head 14 away from its basic position.

The pivotability of the cleaning head 14 about the pivotal axis 48 makes it possible to provide improved cleaning possibilities even in difficult to access locations in that, to a certain extent, the appliance body 12 can be "repositioned" in relation to the surface 16 that is to be cleaned with the aid of the holding bar device 22.

The cleaning head 14 comprises a cleaning roller holder 60 on which the cleaning roller unit 18 is seated such that it is rotatable about the rotational axis 58. The cleaning roller holder 60 is connected to the inner sleeve 52 in mutually non-rotatable manner.

The cleaning roller holder 60 comprises a holding region 62 for the cleaning roller unit 18, and a receptacle chamber 64 for a dirty fluid tank device 66 (see FIG. 3 for example).

The receptacle chamber 64 is positioned between the holding region 62 and the inner sleeve 52. In particular, the inner sleeve 52 is firmly connected to an outer surface of the receptacle chamber 64.

The cleaning roller unit 18 is coupled to the drive motor 28 in torque conveying manner by means of a transmission device 68.

The transmission device 68 connects a motor shaft of the drive motor 28 (which rotates about the motor axis 46) to a shaft 70 for the cleaning roller unit 18 in torque conveying manner.

In one exemplary embodiment, the transmission device 68 comprises a rotary speed reducing gearing. This serves for stepping down a rotary speed in comparison with the rotary speed of the motor shaft. For example, a standard electric motor has rotary speeds in the order of magnitude of 7000 revolutions per minute. The rotary speed reducing gearing provides for a reduction of the rotary speed to about 400 revolutions per minute for example.

The rotary speed reducing gearing can be arranged in the inner sleeve 52 or outside the inner sleeve 52 on the cleaning roller holder 60.

The rotary speed reducing gearing is in the form of a planetary gear system for example.

Furthermore, the transmission device 68 comprises an angular gear which serves to redirect the torque in order to cause the cleaning roller unit 18 to be driven with the rotational axis 58 transverse (and in particular perpendicular) to the motor axis 46. In particular, the angular gear is located downstream of the rotary speed reducing gearing.

In one exemplary embodiment, the angular gear comprises one or more gear wheels which are coupled to a corresponding shaft of the rotary speed reducing gearing in mutually non-rotational manner. These act on a bevel gear wheel for the purposes of effecting the angle-converting process.

Furthermore, the transmission device 68 comprises a belt which, in one exemplary embodiment, is coupled to the angular gear in torque-conveying manner and acts on the shaft 70. The belt bridges the spacing between the shaft 70 and the angular gear and caters for a rotary speed reduction process.

In one exemplary embodiment, the cleaning roller unit 18 is formed in two-pieces consisting of a first part 72 and a second part 74. The first part 72 is seated on a first side of the shaft 70 in mutually non-rotational manner and the second part 74 is seated on a second side that is located opposite the first side of the shaft 70 in mutually non-rotational manner.

The transmission device 68 is housed in an intermediate region 76 between the first part 72 and the second part 74 and is coupled to the shaft 70. They have the same rotational axis 58.

Figure 5:
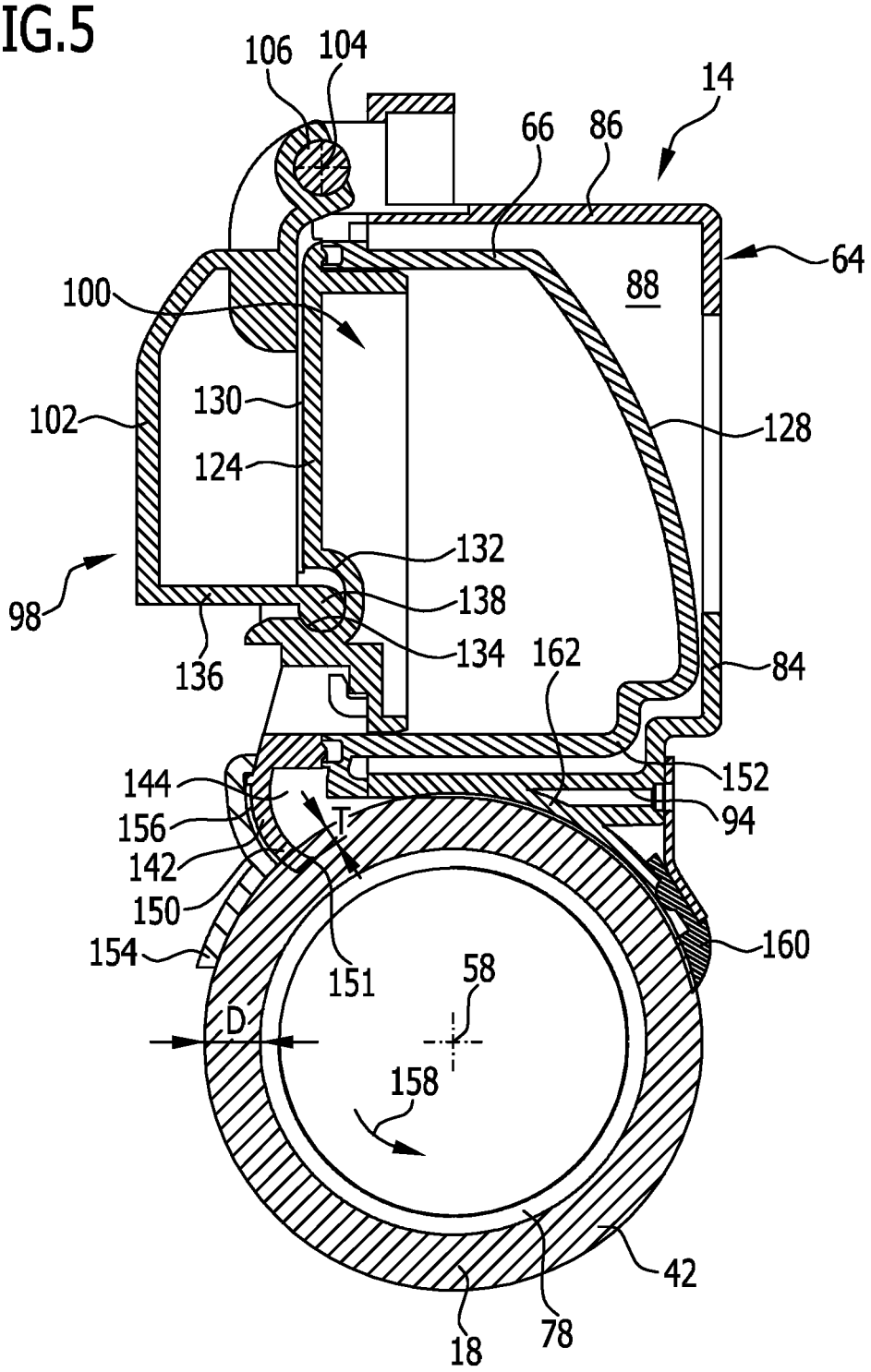
FIG. 5 an enlarged illustration of the region A in accordance with FIG. 4 with a fixed dirty fluid tank device.

The cleaning roller unit 18 or the first part 72 and the second part 74 of the cleaning roller unit 18 comprise a sleeve 78 (c.f. FIG. 5 for example) which is cylindrical. The trimming 42 is arranged on the sleeve 78. The cleaning roller unit 18 or the first part 72 and the second part 74 are fixed to the shaft 70 by means of the sleeve 78.

The cleaning roller unit 18 is arranged on the cleaning head 14 in such a way that the rotational axis 58 is oriented perpendicularly to the longitudinal axis 20.

The length of the cleaning roller unit 18 along the rotational axis 58 between a first end face 80 (which is formed on the first part 72) and a second end face 82 (which is formed on the second part 74) is considerably greater than a corresponding width of the appliance body 12 perpendicular to the longitudinal axis 20. In particular, the length of the cleaning roller unit 18 between the first end face 80 and the second end face 82 is at least 20 cm and preferably at least 25 cm.

The receptacle chamber 64 comprises a bottom 84 (c.f. FIG. 5 for example). A receptacle chamber wall 86 is arranged on the bottom 84 and is oriented transversely relative thereto. The receptacle chamber wall 86 and the bottom 84 of the receptacle chamber 64 define a receiving space 88 for the dirty fluid tank device 66.

Figure 6:
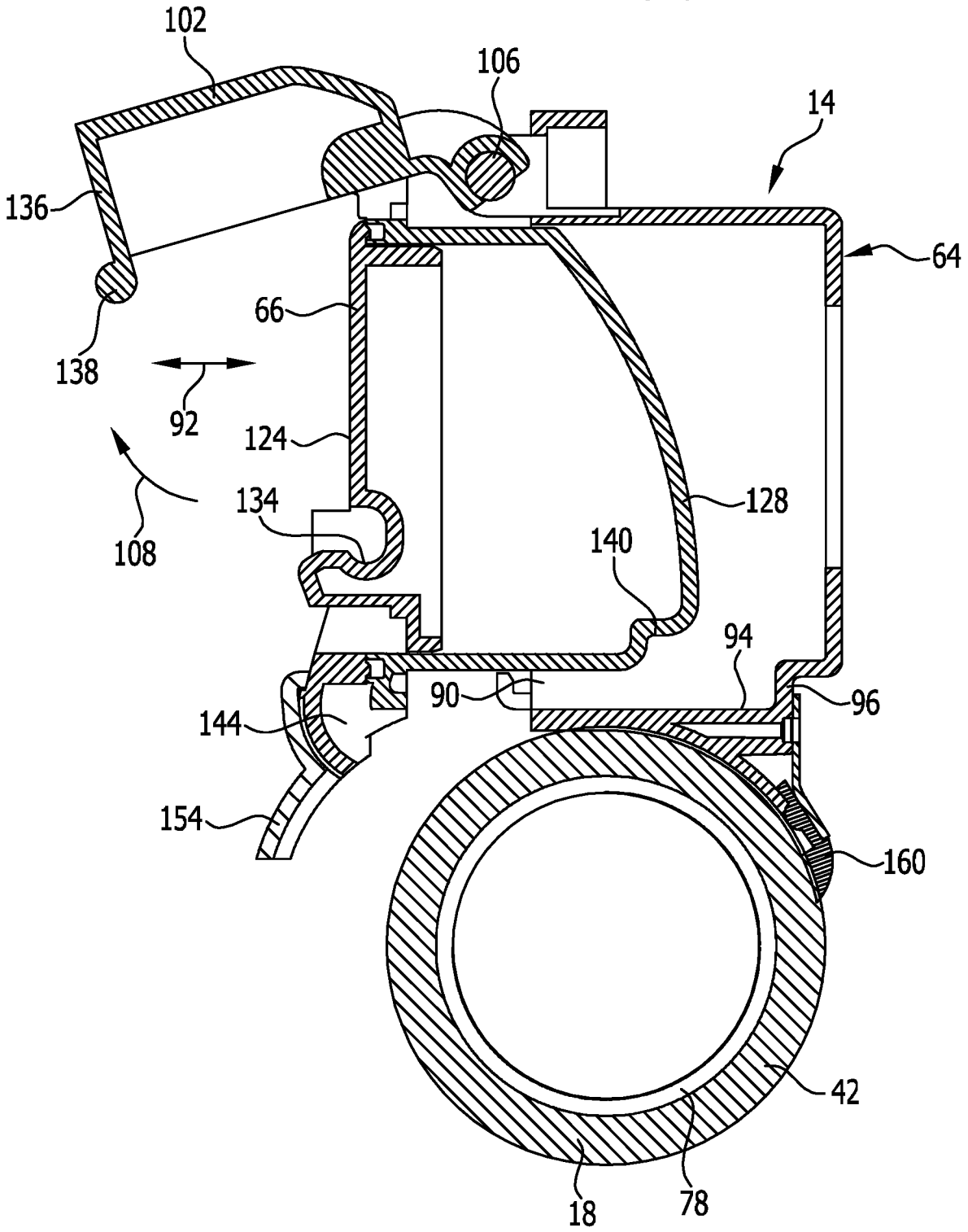
FIG. 6 the same view as FIG. 5, wherein a fixing device is located in a position such that the dirty fluid tank device is extractable.

The receiving space 88 is open in a direction opposite to the bottom 84. The dirty fluid tank device 66 is extractable from the receiving space 88 or is insertible thereinto through the corresponding side 90. The direction of withdrawal or the direction of insertion 92 (c.f. FIG. 6) is substantially perpendicular to the bottom 84 (and perpendicularly to the rotational axis 58).

In one exemplary embodiment, the receptacle chamber wall 86 has a step 96 in a wall region 94 of the receptacle chamber wall 86. Hereby, the wall region 94 faces the holding region 62.

Furthermore, the step 96 is arranged close to the bottom 84.

Associated with the receptacle chamber 64, there is a fixing device 98 with which the dirty fluid tank device 66 is fixable on the receptacle chamber wall 86 in a retaining position 100 (FIG. 5). In particular, the fixing process is effected with positive engagement.

In one embodiment, the fixing device 98 comprises a flap 102 which is arranged on the cleaning head 14 such as to be pivotal about a pivotal axis 104 by means of a swivel joint 106. Hereby, the swivel joint 106 is positioned on or in the proximity of the inner sleeve 52.

The pivotal axis 104 is oriented parallel to the rotational axis 58 of the rotation roller 18.

In the retaining position 100, the flap 102 acts on the dirty fluid tank device 66 and holds the latter on the receptacle chamber 64 in the receiving space 88.

For the purposes of removing the dirty fluid tank device 66 from the cleaning head 14, the flap 102 is pivotal (c.f. this is denoted by the reference symbol 108 in FIG. 6) from this retaining position 100 towards the appliance body 12 in order to release the dirty fluid tank device 66 so that it is extractable from the receiving space 88 on the side 90 in the direction of withdrawal 92 and is removable from the cleaning head 14.

The dirty fluid tank device 66 (FIGS. 8 to 10) is in the form of a unit. It comprises a first chamber 110 which is associated with the first part 72 of the cleaning roller unit 18 and it comprises a second chamber 112 which is associated with the second part 74 of the cleaning roller unit 18.

The first chamber 110 collects the dirty fluid which comes from the first part 72 of the cleaning roller unit 18, and the second chamber 112 collects the dirty fluid which comes from the second part 74 of the cleaning roller unit 18.

In principle hereby, it is possible for the first chamber 110 and the second chamber 112 to be connected to one another in fluid conveying manner and, for example, thereby be connected to a common emptying-opening in fluid conveying manner.

Provision may also be made for the first chamber 110 and the second chamber 112 to be separated from each other in fluid-tight manner and for each chamber 110, 112 to comprise its own outlet opening.

The first chamber 110 and the second chamber 112 are mutually spaced; the dirty fluid tank device 66 comprises a recess 114 between the first chamber 110 and the second chamber 112. The recess 114 is arranged in a middle region of the dirty fluid tank device 66 taken with respect to a longitudinally extending axis 116 of the dirty fluid tank device 66.

When the dirty fluid tank device 66 is fixed on the cleaning head 14 in the retaining position 100, then the longitudinally extending axis 116 is oriented parallel to the rotational axis 58 of the cleaning roller unit 18.

The longitudinally extending axis 116 of the dirty fluid tank device 66 runs between a first outer end 118 and a second outer end 120 of the dirty fluid tank device 66, wherein the largest longitudinal dimensions of the dirty fluid tank device 66 are between the first outer end 118 and the second outer end of 120.

The recess 114 provides a passage through at least a partial region of the transmission device 68. The cleaning roller unit 18 is driven centrally. The transmission device 68 bridges the distance between the drive motor 28 and the shaft 70. To a certain extent, the recess 114 leaves free the spatial region in the dirty fluid tank device 86 which accommodates the transmission device 68.

Provision may be made for the receptacle chamber 64 to comprise a respective receiving space 88 for the first chamber 110 and the second chamber 112.

It is also possible for a common receiving space 88 to be provided for the first chamber 110 and the second chamber 112.

The first chamber 110 and the second chamber 112 are connected to one another by a bridge 122 so that the dirty fluid tank device 66 forms a unit and is removable as a whole from or is insertible as a whole into the cleaning head 14.

In one exemplary embodiment, the dirty fluid tank device 66 comprises a cover flap 124 which is seated on the first chamber 110 and the second chamber 112 in pivotal manner by means of spaced swivel joints 126*a*, 126*b*.

The cover flap 124 can be lifted up in order to provide a corresponding emptying opening for the first chamber 110 and the second chamber 112 and enable an interior space of the dirty fluid tank device 66 to be cleaned if necessary.

Figure 8:
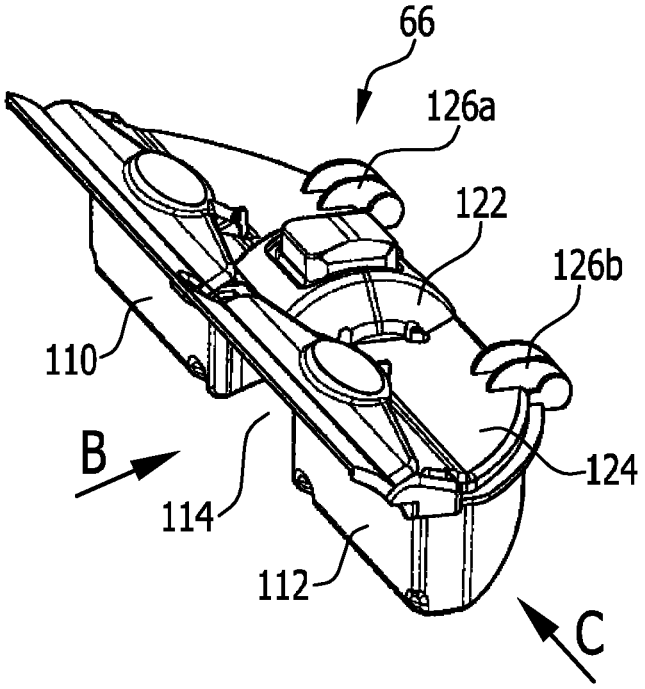
FIG. 8 a perspective view of an exemplary embodiment of a dirty fluid tank device.
Figure 9:
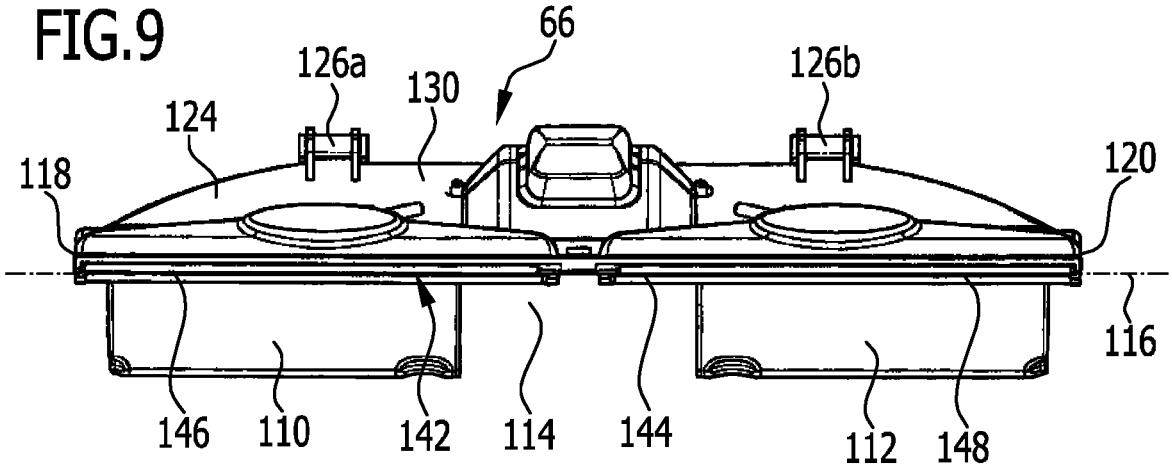
FIG. 9 a view of the dirty fluid tank device in accordance with FIG. 8 in the direction B.
Figure 10:
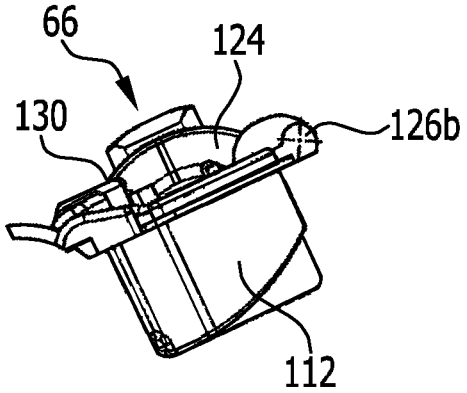
FIG. 10 a side view of the dirty fluid tank device in accordance with FIG. 8 in the direction C.

In one exemplary embodiment which is shown in FIGS. 8 to 10, the first chamber 110 and the second chamber 112 are separated from each other in fluid-tight manner. The cover flap 124 is a common cover flap for both the first chamber 110 and the second chamber 112. By opening the cover flap 124, both the first chamber 110 and the second chamber 112 can then be emptied or access to the first chamber 110 and the second chamber 112 is established in order to enable an appropriate cleaning process to be carried out.

The cover flap is fixable to the first chamber 110 and/or the second chamber 112 and/or the bridge 122 in such a manner that, (apart from an inlet orifice) there is provided a fluid-tight dirty fluid tank device 66 when the cover flap 124 is closed.

In principle, it is also possible for the dirty fluid tank device 66 to comprise mechanically separated chambers, wherein a respective chamber is then associated with the first part 72 and the second part 74 of the cleaning roller unit 18. In this case, the corresponding parts of the dirty fluid tank device must then be separately removed from or inserted into the cleaning head 14.

The dirty fluid tank device 66 comprises a lower surface 128 which is formed on the first chamber 110 and on the second chamber 112 on a respective outer surface of the bottom 84. Furthermore, it comprises an upper surface 130 which is located opposite the lower surface 128 and is formed on an outer surface of the cover flap 124.

A recess 132 is (or a plurality of recesses 132 are) formed in the upper surface 130 of the dirty fluid tank device 66 and thus on the cover flap 124. The recess or recesses 132 are groove-like and comprise an undercut surface 134.

The flap 102 comprises a counter element 136 (or a plurality of counter elements 136) which serve for co-operating with the recess 132.

Figure 7:
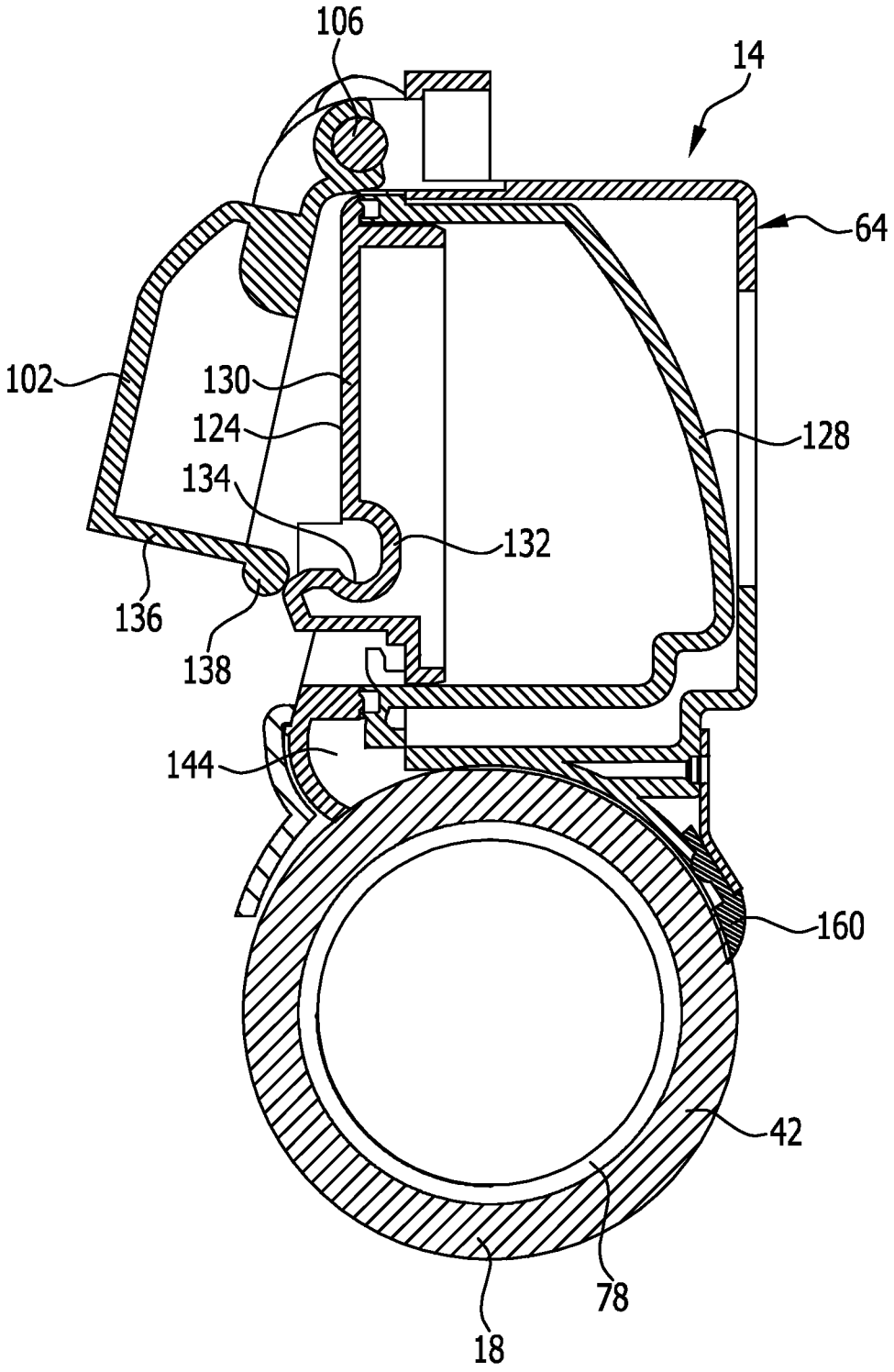
FIG. 7 the same view as FIG. 5 in an intermediate position.

A locking element 138 which serves for co-operating with the undercut surface 134 is arranged on the counter element 136 or the counter elements 136 (FIGS. 5 to 7). When the counter element 136 together with its locking element 138 are inserted into the recess 132 and the retaining position 100 is reached, then the locking element 138 abuts on the undercut surface 134. The flap 102 is thereby blocked from pivoting away from the upper surface 130 of the dirty fluid tank device 66. An appropriate amount of force must be exerted in order to move the locking element 138 away from the undercut surface 134.

The dirty fluid tank device 66 is positioned in relation to the flap 102 and the receptacle chamber 64 in such a way that, when the dirty fluid tank device 66 is positioned on the receptacle chamber 64 in the retaining position 100, the locking element 138 has entered into the recess 132 and accordingly rests on the undercut surface 134 and therefore secures the retaining position 100.

In one exemplary embodiment, the dirty fluid tank device 66 comprises a step 140 which matches the step 96 (c.f. FIG. 6 for example).

When the dirty fluid tank device 66 is inserted into the receiving space 88, then the receptacle chamber wall 86 blocks any movement of the dirty fluid tank device 66 in the receiving space 88 in the directions transverse to the withdrawal/insertion direction 92.

This positive-locking type of blockage is supported if necessary by the steps 96, 140.

The bottom 84 of the receptacle chamber 64 prevents the dirty fluid tank device 66 from "lifting up" when it is being inserted.

When the flap 102 is closed and the locking element 138 is positioned in the recess 132 such that it is abutting on the undercut surface 134, then any movement parallel to the withdrawal direction 92 is blocked, and the retaining position 100 of the dirty fluid tank device 66 on the receptacle chamber 64 is secured.

In particular, the flap 102 is in the form of a retaining device which provides for a defined positioning of the dirty fluid tank device 66 in relation to the cleaning roller unit 18.

In particular, the flap 102 is arranged or formed resiliently in such a way that the flap 102 exerts a corresponding positioning force in the retaining position 100 and in particular thereby, the dirty fluid tank device 66 is pressed against the bottom 84 and also the wall region 94. The pressure against the wall region 94 is also assisted by the co-operation of the step 96 in the wall region 94 with the step 140 in the dirty fluid tank device 66.

Provision may be made for the flap 102 to be spring mounted on the swivel joint 106 for example. As an alternative or in addition thereto, the flap 102 can, for example, be formed on the counter element 136 in such a way that a corresponding resilient force is exercisable on the dirty fluid tank device 66.

The cleaning head 14 comprises a scraper guide device 142 or stripper guide device 142 (c.f. FIG. 5) which acts on the cleaning roller unit 18 (and hence on the first part 72 and the second part 74) and serves for the purpose of removing from the cleaning roller unit 18 dirty fluid (in particular water with dirt particles) that is being carried along thereby and supplying it to an inlet orifice 144 of the dirty fluid tank device 66 which is fixed on the cleaning head 14 in the retaining position 100. Hereby, dirty fluid is then coupled into the dirty fluid tank device 66.

The inlet orifice 144 of the dirty fluid tank device 66 is in the form of a slot (FIG. 9). It comprises a first part 146 which is an inlet orifice for the first chamber 110, and it comprises a second part 148 which is an inlet orifice for the second chamber 112.

In the exemplary embodiment shown in FIG. 9, the first part 146 and the second part 148 are each longer along the longitudinally extending axis 116 than the respectively associated chamber 110 and 112. The dirty fluid tank device 66 comprises a respective wall on the first part 146 and on the second part 148 at the end of the inlet orifice 144 in order to enable dirty fluid that has been collected by the first part 146 and the second part 148 of the inlet orifice 144 to be supplied to the first chamber 110 and the second chamber 112 respectively.

The first part 146 of the inlet orifice 144 is associated with the first part 72 of the cleaning roller unit 18. The second part 148 of the inlet orifice 144 is associated with the second part 74 of the cleaning roller unit 18. The first part 146 and the second part 148 of the inlet orifice 144 are spaced from each other in correspondence with the spacing of the first part 72 and the second part 74.

Preferably, the lengths of the first part 146 and the second part 148 along the longitudinally extending axis 116 each correspond at least approximately to a corresponding length of a trimming on the first part 72 and the second part 74 of the cleaning roller unit 18 along the rotational axis 58.

The scraper guide device 142 is formed in such a way that dirty fluid is scraped from the cleaning roller unit 18 thereby and fed into the inlet orifice 144.

It is possible that a guiding effect is obtained due to the effect of centrifugal force when the cleaning roller unit 18 is effecting a rotary movement and dirty fluid is thereby spun off as it were into the dirty fluid tank device 66.

The scraper guide device 142 is spaced from the rotational axis 58.

In one embodiment (c.f. FIG. 5 for example), the scraper guide device 142 projects into the trimming 42 of the cleaning roller unit 18 up to a depth T. In particular, the depth T amounts to at least 5% of a thickness D (FIG. 5) of the trimming 42 of the cleaning roller unit 18 with reference to a dampened state of the trimming 42.

In particular, the scraper guide device 142 is formed by one or more edge elements (ridge elements) 150. For example, a respective edge element 150 is associated with the first part 72 and the second part 74 of the cleaning roller unit 18.

An edge element 150 is in the form of a strip which projects accordingly into the trimming 42 of the cleaning roller unit 18 on the first part 72 and the second part 74.

The edge element 150 has a relatively small thickness which, in particular, is smaller than a thickness D of the trimming 42.

In one exemplary embodiment, the edge element 150 or the edge elements 150 are curved.

In particular, the scraper guide device 142 together with the edge element 150 or the edge elements 150 forms a wall of the inlet orifice 144.

The one or the plurality of edge elements 150 are rounded-off or chamfered at an edge which faces the inlet orifice 144. The fibers of the trimming 42 will thereby be preserved and only a very small force has to be overcome during the rotation of the cleaning roller unit 18. This in turn achieves an energy saving effect. This rounding at the edge is indicated in FIG. 5 by the reference symbol 151.

In principle, provision may be made for the scraper guide device 142 to be arranged on the cleaning roller holder 60.

In the exemplary embodiment shown, the scraper guide device 142 is seated on the dirty fluid tank device 66.

The latter comprises a wall 152 which faces the wall region 94 in the retaining position 100. The one or the plurality of edge elements 150 are arranged on the corresponding wall 152 of the first chamber 110 and the second chamber 112.

Preferably thereby, the corresponding scraper guide device 142 is arranged outside the cover flap 124 of the dirty fluid tank device 66.

In this embodiment, the scraper guide device 142 is removed from the cleaning head 14 when the dirty fluid tank device 66 is removed therefrom.

Furthermore, provision is made for a covering 154 to be positioned on the cleaning head 14 of the associated cleaning roller unit 18. The covering 154 is arranged such as to follow the scraper guide device 142 (with the one or the plurality of edge elements 150). The edge element 150 is curved in such a way that it matches a corresponding curvature of the cleaning roller unit 118 with the trimming 42.

In principle, the covering 154 can touch the trimming 42 or penetrate into it, wherein the penetration is preferably of lesser depth than the penetration to the depth T by the scraper guide device 142.

In one exemplary embodiment, the fluid line 40 or the fluid lines 40 open out into a region 156 between the covering 154 and the scraper guide device 142. The cleaning roller unit 18 can then be acted upon by cleaning liquid from the tank device 34 within this region.

In particular, the length of the region 146 along the rotational axis 58 corresponds at least approximately to a corresponding length of the first part 72 or the second part 74 of the cleaning roller unit 18 in order to enable the liquid to be distributed evenly over the length of the cleaning roller unit 18.

In the exemplary embodiment shown, the covering 154 is arranged on the dirty fluid tank device 66.

Accordingly, care must then be taken to ensure that a suitable coupling of the fluid line 40 or the fluid lines 40 is achieved.

Taken with respect to a direction of rotation 158 (c.f. FIG. 5) of the cleaning roller unit 18 in the course of a cleaning operation, the scraper guide device 142 together with its edge element 150 or its edge elements 150 is arranged after the inlet orifice 144. Consequently, it is made possible for dirty fluid that was previously being carried along by the cleaning roller unit 18 from the surface that is to be cleaned 16 and transported toward the scraper guide device 142 to be "centrifuged" by the scraper guide device 142 into the inlet orifice 144 and thus into the dirty fluid tank device 66.

Furthermore, in one embodiment there is provided a sweeping element 160 which is associated with the cleaning roller unit 18 and which serves for the purpose of supplying coarse dirt to the cleaning roller unit 18. This dirt can then be carried along therewith by the cleaning roller unit 18.

The inlet orifice 144 is arranged between the scraper guide device 142 on and the sweeping element 160.

In the exemplary embodiment shown, the sweeping element 160 is positioned on the cleaning roller holder 60 in the holding region 62. The sweeping element 160 is set-up in such a way that (when the surface cleaning machine 10 is not set too steeply) it can be effective for the function of sweeping the surface 16 that is to be cleaned at least in an angular positional range of the surface cleaning machine 10 taken with respect to the longitudinal axis 20 to the surface 16 that is to be cleaned.

For example, the sweeping element 160 is arranged to be pivotal on the cleaning roller holder 60 and/or it is formed resiliently.

In particular, the sweeping element 160 projects into the trimming 42 of the cleaning roller unit 18. However, it could just touch the trimming 42 or be spaced therefrom.

Taken with respect to the direction of rotation 158 of the cleaning roller unit 18 when it is driven by the drive motor 28 into rotational movement, the first thing to appear on the surface 16 that is to be cleaned is the sweeping element 160, then a guidance region 162 of the cleaning roller holder 60 which has a (hollow) cylindrical shape and is matched to the cleaning roller unit 18, then the inlet orifice 144 followed by the scraper guide device 142 with the one or the plurality of edge elements 150 and finally the covering 154, wherein the region 156 lies between the covering 154 and the scraper guide device 142.

In the embodiment shown, the surface cleaning machine 10 is constructed without a suction fan. Dirty fluid which is being carried along by the cleaning roller unit 18 is not sucked into the dirty fluid tank device 66 by an additional suction fan, but rather, the scraper guide device 142 alone ensures that dirty fluid is coupled into the dirty fluid tank device 66.

In principle however, it is possible for the coupling process to be supported by an additional suction fan.

The surface cleaning machine 10 functions as follows:

In a cleaning operation, the dirty fluid tank device 66 is fixed on the cleaning head 14 in the retaining position 100.

For a cleaning process, the surface cleaning machine 10 is placed on the surface 16 that is to be cleaned merely by means of the cleaning roller unit 18. The drive motor 28 drives the cleaning roller unit 18 into rotary movement about the (only) rotational axis 58 in the direction of rotation 158.

The cleaning roller unit 18 is acted upon by cleaning fluid from the tank device 34.

Dirt on the surface 16 that is to be cleaned is dampened when the dampened trimming 42 of the cleaning roller unit 18 acts thereon in order to facilitate its removal.

The rotation of the cleaning roller unit 18 has a mechanical effect on dirt on the surface 16 that is to be cleaned in order to improve the removal thereof from the surface 16 that is to be cleaned.

Any coarse dirt can be conveyed to the cleaning roller unit 18 by the sweeping element 160.

Dirty fluid (dirt particles, cleaning liquid with dissolved dirt) is carried along by the cleaning roller unit 18 and the dirty fluid is removed from the cleaning roller unit 18 at the scraper guide device 142 and fed (inter alia by the effect of the centrifugal force) into the inlet orifice 144 and from there it passes into the dirty fluid tank device 66. The scraper guide device 142 provides for the removal of dirty fluid from the trimming 42 of the cleaning roller unit 18 by means of a scraping action.

In particular, the coupling of dirty fluid into the dirty fluid tank device 66 is effected without a suction fan.

The dirty fluid tank device 66 is positioned on the cleaning head 14 such as to be removable therefrom.

The flap 102 provides for securing the retaining position 100. In the retaining position 100, the inlet orifice 144 of the dirty fluid tank device 66 is aligned with respect to the cleaning roller unit 18 as well as in relation to the scraper guide device 142 in such a way that the corresponding removal function and coupling function are achieved as described above.

The flap 102 ensures by virtue of its function as a retaining device that the edge element 150 or the edge elements 150 are accordingly pressed into the trimming 42 up to the depth T in order to achieve an optimal removal function by the scraping process.

In particular, the scraper guide device 142 is arranged on the dirty fluid tank device 66 and is removable therewith from the cleaning head 14.

The flap 102 presses by virtue of its counter element 136 and the locking element 138 that is arranged thereon upon the upper surface 130 of the dirty fluid tank device 66 and thereby secures the retaining position in which the positioning of the scraper guide device 142 relative to the cleaning roller unit 18 that was described above is also achieved.

A positively-locking arrangement for mounting the dirty fluid tank device 66 on the receptacle chamber 64 in the retaining position 100 is provided.

For the purposes of removing the dirty fluid tank device 66 (FIG. 3, FIGS. 6, 7), the flap 102 is opened. It is pivoted towards the appliance body 12. In order to guide the locking element 138 out from the recess 132 with the undercut surface 134, appropriate resilient deformation of the counter elements 136 has to be effected.

The dirty fluid tank 66 can then be taken out (c.f. FIG. 3) when the flap 102 is fully opened (FIG. 6).

By opening the cover flap 124 of the dirty fluid tank device 66, the latter can be emptied and can be cleaned if necessary by rinsing it out for example.

The dirty fluid tank device 66 has a capacity of about 150 ml for example.

The surface cleaning machine 10 has a relatively low power consumption as a suction fan does not have to be provided and dirty fluid is coupled directly from the cleaning roller unit 18 into the dirty fluid tank device 66 over a "minimized path".

Consequently, the surface cleaning machine 10 can be operated optimally by a re-chargeable battery device 44.

A process of damp cleaning hard floors with a high degree of automation can be carried out by means of the surface cleaning machine in accordance with the invention. The amount of force required for the wiping action is reduced or even eliminated due to the mechanical support by the driven rotation roller 18. The moistening of the cleaning roller unit 18 makes it possible for a user to accomplish a cleaning process without coming into contact with dirty fluid.

Moreover, a process of self-cleaning the cleaning roller unit 18 occurs to a certain degree in the course of a cleaning operation.

The dirty fluid tank device 66 is arranged between the cleaning roller unit 18 and the drive motor 28. A longitudinally extending direction of the inlet orifice 144 which lies parallel to the longitudinally extending axis 116 is parallel to the rotational axis 58 of the cleaning roller unit 18 and transverse and in particular perpendicular to the motor axis 46. Furthermore, this longitudinally extending axis of the inlet orifice 144 is transverse and in particular perpendicular to the longitudinal axis 20.

Provision may also be made for the drive motor 28 to be used for driving one or more suction turbines which are connected to an interior space of the dirty fluid tank device 66 in fluid conveying manner in order to produce a negative pressure which improves the coupling of dirty fluid into the dirty fluid tank device.

In principle, the surface cleaning machine 10 could also be operated using mains power.

The sweeping element 160 can also be arranged on the dirty fluid tank device 66.

An overload protection arrangement can be provided. This, for example, is in the form of a mechanical overload protector which comprises a slipping clutch for example. As an alternative or in addition thereto, provision may be made for an electronic overload protection arrangement which is effective to disconnect an excess-current for example.

In a normal cleaning operation, the tank device 34 is arranged above the cleaning head 14 taken with respect to the gravitational direction. Cleaning liquid can thereby flow in pump-free manner from the tank device 34 to the cleaning head 14 under the effect of gravitational force in order to subject the surface 16 that is to be cleaned directly or indirectly with cleaning liquid by means of the cleaning roller unit 18.

The surface cleaning machine 10 can be formed in such a way that the sweeping element 160 only becomes effective when a certain angular position with respect to the longitudinal axis 20 to the surface 16 that is to be cleaned is adopted and in particular an angle between the surface 16 that is to be cleaned and the longitudinal axis which lies below a maximum angle.

A further exemplary embodiment of a surface cleaning machine 202 in accordance with the invention (FIG. 11) comprises a cleaning head 204.

A first cleaning roller unit 206 is arranged on the cleaning head 204 such as to be rotatable about a first rotational axis 208. Furthermore, spaced from the first cleaning roller unit 206, a second cleaning roller unit 210 is arranged on the cleaning head 204 such as to be rotatable about a second rotational axis 212. The first rotational axis 208 and the second rotational axis 212 are oriented in parallel with one another.

In the exemplary embodiment shown, the cleaning roller units 206 and 210 are each in the form of cleaning rollers that are formed in one-piece.

The surface cleaning machine 202 comprises a drive for the first cleaning roller unit 206 and the second cleaning roller unit 210. In one exemplary embodiment, a drive 214 is arranged on the cleaning head 204.

The drive acts directly or through a transmission device on the first cleaning roller unit 206 and the second cleaning roller unit 212 in such a manner that these rotate in opposite senses.

Figure 11:
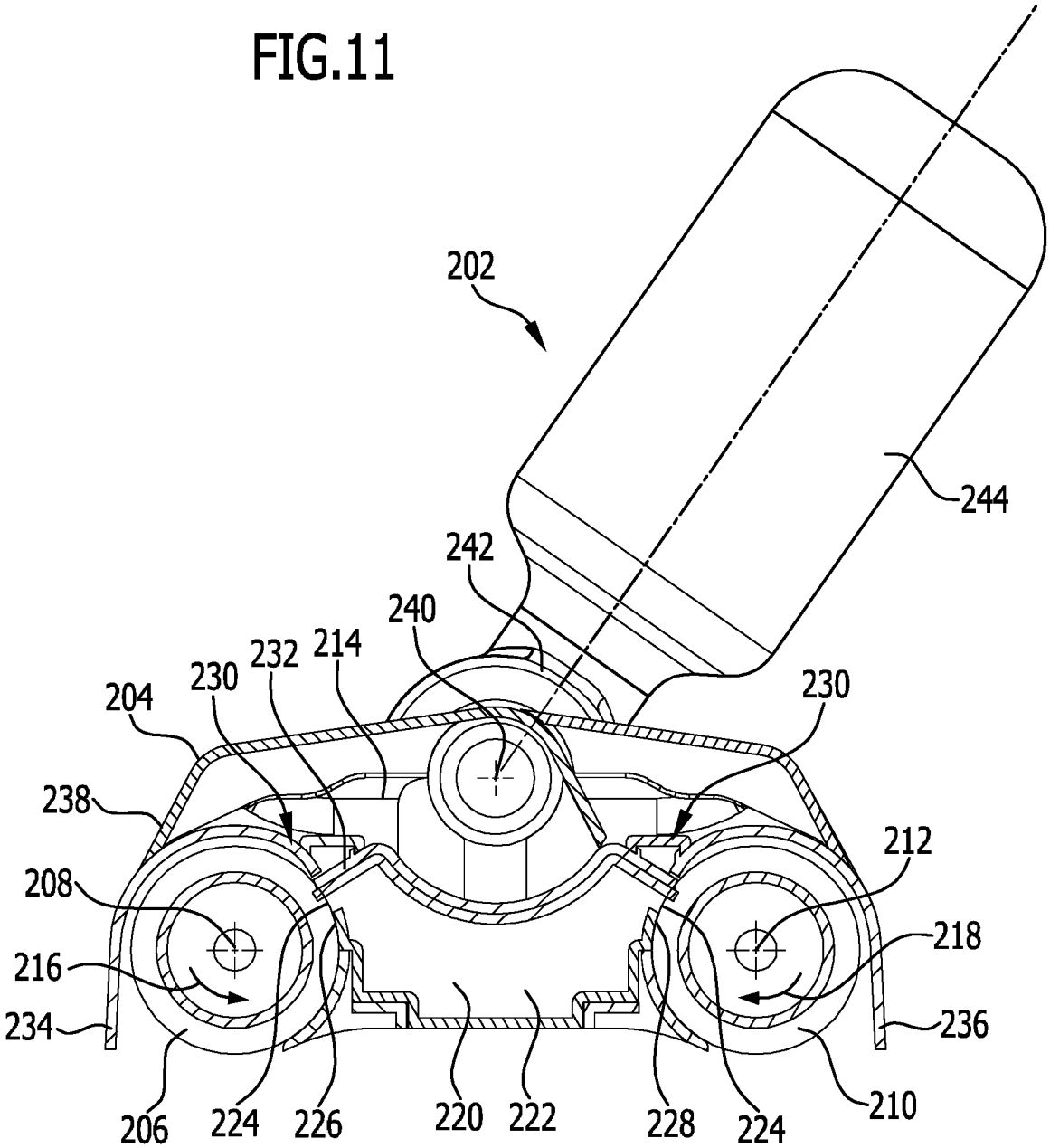
FIG. 11 a schematic cutaway view of a cleaning head of a further exemplary embodiment of a surface cleaning machine in accordance with the invention.

In the exemplary embodiment shown in FIG. 11, the first cleaning roller unit 206 has a first direction of rotation 216 and the second cleaning roller unit 210 has a second direction of rotation 218 which is in the opposite direction to the first direction of rotation 216.

A dirty fluid tank device 220 is arranged on the cleaning head 204.

In one exemplary embodiment, the dirty fluid tank device 220 comprises a common tank 222 for the first cleaning roller unit 206 and the second cleaning roller unit 210.

The tank 222 comprises an inlet orifice 224. This is composed of a first part 226 which is associated with the first cleaning roller unit 206, and a second part 228 which is associated with the second cleaning roller unit 210.

The first part 226 and the second part 228 are aligned in parallel with each other and are oriented parallel to the rotational axes 208, 212.

Dirty fluid that is being carried along by the first cleaning roller unit 206 can be coupled into the tank 222 via the first part 226 of the inlet orifice 224. Dirty fluid that is being carried along by the second cleaning roller unit 210 can be coupled into the tank 222 via the second part 228 of the inlet orifice 224.

A scraper guide device 230 is arranged on the cleaning head 204. The scraper guide device 230 comprises appropriate edge elements 232 which are arranged on the first part 226 of the inlet orifice 224 and on the second part 228 of the inlet orifice 224.

As described above on the basis of the surface cleaning machine 10, the edge elements 232 project up to a certain depth into a respective trimming of the first cleaning roller unit 206 and the second cleaning roller unit 210.

Taken with respect to the first direction of rotation 216 or the second direction of rotation 218, the edge elements 232 are arranged after the first part 226 and the second part 228 of the inlet orifice 224.

They function in the same manner as the edge elements 150 described above. They form a wall of the parts 226, 228 of the inlet orifice 224.

Furthermore, a first sweeping element 234 is associated with the first cleaning roller unit 206 and a second sweeping element 236 is associated with the second cleaning roller unit 210.

In particular, the first cleaning roller unit 206 and the second cleaning roller unit 210 are positioned between the first sweeping element 234 and the second sweeping element 236.

The first sweeping element 234 and the second sweeping element 236 are preferably fixed to a cleaning roller holder 238 which holds the first cleaning roller unit 206 and the second cleaning roller unit 210.

The first sweeping element 234 and the second sweeping element 236 function in the same manner as the sweeping element described on the basis of the surface cleaning machine 10.

The tank 222 is, for example, formed such that it is removable. It could also be positioned firmly on the cleaning head 204.

In one embodiment, an appliance body is pivotal relative to the cleaning head 204 about a pivotal axis 240 by means of a swivel joint 242. The appliance body is indicated in FIG. 11 by the reference symbol 244.

When the surface cleaning machine 202 is guided across a surface that is to be cleaned by the cleaning head 204, then both the first cleaning roller unit 206 and the second cleaning roller unit 210 are affective on this surface that is to be cleaned. As a result of the rotation in opposite directions, there ensues a good cleaning effect.

Dirty fluid (dirt particles, cleaning liquid possibly with dissolved dirt) is carried along by the first cleaning roller unit 206 and the second cleaning roller unit 210. Dirty fluid is removed from the first cleaning roller unit 206 and the second cleaning roller unit 210 by the scraper guide device 230 in the same way as was described above and is coupled into the dirty fluid tank device 220 at the respective first part 226 and second part 228 of the inlet orifice 224.

The process of coupling the dirty fluid is effected without a suction fan.

The inlet orifice 224 is arranged in the direct proximity of the first cleaning roller unit 206 and the second cleaning roller unit 210.

LIST OF REFERENCE SYMBOLS

10 surface cleaning machine
12 appliance body
14 cleaning head
16 surface that is to be cleaned
18 cleaning roller unit
20 longitudinal axis
22 holding bar device
24 holding bar
26 grip
28 drive motor
30 housing
32 holder
34 tank device for cleaning liquid
36 tank receptacle
38 valve device
39 filter device
40 fluid line
72 trimming
44 battery device
46 motor axis
48 pivotal axis
50 double arrow
52 inner sleeve
54 outer sleeve
56 swivel joint
58 rotational axis
60 cleaning roller holder
62 holding region
64 receptacle chamber
66 dirty fluid tank device
68 transmission device
70 shaft
72 first part
74 second part
76 intermediate region
78 sleeve
80 first end face
82 second end face
84 bottom
86 receptacle chamber wall
88 receiving space
90 side
92 direction of withdrawal/insertion
94 wall region
96 step
98 fixing device
100 retaining position
102 flap
104 pivotal axis
106 swivel joint
108 direction
110 first chamber
112 second chamber
114 recess
116 longitudinally extending axis
118 first outer end
120 second outer end
122 bridge
124 cover flap
**126*a*** swivel joint
**126*b*** swivel joint
128 lower surface
130 upper surface
132 recess
134 undercut surface
136 counter element
138 locking element
140 step
142 scraper guide device
144 inlet orifice
146 first part
148 second part
150 edge element
151 rounding, chamfer
152 wall
154 covering
156 region
158 direction of rotation
160 sweeping element
162 guidance region
202 surface cleaning machine
204 cleaning head
206 first cleaning roller unit
208 first rotational axis
210 second cleaning roller unit
212 second rotational axis
214 drive
216 first direction of rotation
218 second direction of rotation
220 dirty fluid tank device
222 tank
224 inlet orifice
226 first part of the inlet orifice
228 second part of the inlet orifice
230 scraper guide device
232 edge element
234 first sweeping element
236 second sweeping element
238 cleaning roller holder
240 pivotal axis
242 swivel joint

244 appliance body

The invention claimed is:

1. Surface cleaning machine comprising an appliance body;

a cleaning head which is arranged on the appliance body;

wherein at least one driven cleaning roller unit is positioned on the cleaning head and a dirty fluid tank device is arranged on the cleaning head;

a drive motor; and a scraper guide device which acts on the at least one cleaning roller unit and is associated with the at least one cleaning roller unit;

wherein the scraper guide device is arranged at an inlet orifice of the dirty fluid tank device;

wherein the scraper guide device is arranged and formed in such a way that dirty fluid is couplable from the at least one cleaning roller unit via the inlet orifice of the dirty fluid tank device into the dirty fluid tank device without a suction fan; and wherein the dirty fluid tank device is arranged between the at least one cleaning roller unit and the drive motor.

2. The surface cleaning machine in accordance with claim 1, wherein the scraper guide device is arranged and formed in such a way that dirty fluid which has been picked up by the at least one cleaning roller unit is scraped off the at least one cleaning roller unit by the scraper guide device and is guided into the dirty fluid tank device.

3. The surface cleaning machine in accordance with claim 1, wherein the scraper guide device is arranged after the inlet orifice taken with respect to the direction of rotation of the at least one cleaning roller unit.

4. The surface cleaning machine in accordance with claim 1, wherein the scraper guide device projects into a trimming of the at least one cleaning roller unit.

5. The surface cleaning machine in accordance with claim 4, wherein the scraper guide device projects into the trimming of the at least one cleaning roller unit to a depth of at least 5% of the thickness of the trimming with reference to a moist trimming.

6. The surface cleaning machine in accordance with claim 1, wherein the scraper guide device is arranged on the dirty fluid tank device or on a cleaning roller holder.

7. The surface cleaning machine in accordance with claim 1, wherein the scraper guide device is removable from the cleaning head with the dirty fluid tank device.

8. The surface cleaning machine in accordance with claim 1, wherein the scraper guide device is rounded-off or chamfered at an edge trimming the inlet orifice.

9. The surface cleaning machine in accordance with claim 1, wherein the scraper guide device is formed by one or more edge elements.

10. The A surface cleaning machine in accordance with claim 1, wherein there is associated with the at least one cleaning roller unit at least one sweeping element by means of which coarse dirt is conveyable to the at least one cleaning roller unit so as to be carried along thereby.

11. The surface cleaning machine in accordance with claim 10, wherein the inlet orifice of the dirty fluid tank device is positioned between the scraper guide device and the sweeping element that is associated with the at least one cleaning roller unit taken with respect to a direction of rotation of the at least one cleaning roller unit.

12. The surface cleaning machine in accordance with claim 10, wherein the at least one sweeping element is arranged on the dirty fluid tank device or a cleaning roller holder.

13. The surface cleaning machine in accordance with claim 1, wherein the cleaning head is arranged on the appliance body in pivotal manner.

14. The surface cleaning machine in accordance with claim 1, wherein the drive motor is arranged on the appliance body outside a housing of the appliance body or at least partly in the housing of the appliance body.

15. The surface cleaning machine in accordance with claim 1, wherein at least one first cleaning roller unit and one second cleaning roller unit are provided, and wherein the first cleaning roller unit and the second cleaning roller unit are driven such as to be rotary in opposite directions.

16. The surface cleaning machine in accordance with claim 15, wherein at least one common tank of the dirty fluid tank device is associated with the first cleaning roller unit and the second cleaning roller unit.

17. The surface cleaning machine in accordance with claim 1, wherein the inlet orifice of the dirty fluid tank device has a longitudinally extending direction which is oriented at least approximately parallel to a rotational axis of the at least one cleaning roller unit.

18. The surface cleaning machine in accordance with claim 1, wherein the inlet orifice of the dirty fluid tank device has a length which corresponds at least to the length of a trimming on the at least one cleaning roller unit.

19. The surface cleaning machine in accordance with claim 1, characterized by being constructed in the form of a handheld or hand-guided surface cleaning machine.

* * * * *